United States Patent [19]

DeLigt

[11] 4,152,202

[45] May 1, 1979

[54] METHOD AND APPARATUS FOR LEVELING THE CROSS-DIRECTION PROFILE OF STOCK SLURRY ON A PAPER MACHINE

[75] Inventor: John DeLigt, Covington, Va.

[73] Assignee: Westvaco Corporation, New York, N.Y.

[21] Appl. No.: 855,997

[22] Filed: Nov. 30, 1977

Related U.S. Application Data

[63] Continuation-in-part of Ser. No. 710,565, Aug. 2, 1976, abandoned.

[51] Int. Cl.[2] ..... D21F 1/08

[52] U.S. Cl. ..... 162/198; 162/208; 162/252; 162/253; 162/258; 162/263; 162/310; 162/DIG. 11; 239/543; 239/551

[58] Field of Search ..... 162/198, 208, 252, 258, 162/263, 297, 310, DIG. 7, DIG. 11, 253; 137/601, 552.5; 239/551, 76, 565, 543, 557

[56] References Cited

U.S. PATENT DOCUMENTS

| | | | |
|---|---|---|---|
| 1,989,435 | 1/1935 | Wallguist | 162/208 |
| 2,951,007 | 8/1960 | Lippke | 162/198 |
| 3,072,146 | 1/1963 | Gizeski | 239/76 |
| 3,407,114 | 10/1968 | Springuel | 162/258 |
| 3,437,098 | 4/1969 | Stark et al. | 137/552.5 |
| 3,587,969 | 6/1971 | Gromme | 239/76 |
| 3,989,085 | 11/1976 | Crosby | 162/DIG. 11 |

OTHER PUBLICATIONS

Halliday & Resnick; Physics Parts I & II; pp. 443–445, John Wiley & Sons, Inc.; N. Y., 1966.

*Primary Examiner*—S. Leon Bashore
*Assistant Examiner*—Steve Alvo
*Attorney, Agent, or Firm*—W. Allen Marcontell; Ernest B. Lipscomb, III

[57] ABSTRACT

The characteristic profile of a paper web is adjusted on the fourdrinier by means of a number of fluid spray stations positioned across the papermachine. Each spray station is provided with two or more fan spray nozzles of different flow capacity oriented to impact the pond with fluid along a common line. Flow to each nozzle is binary controlled with respective binary command, full flow valves. By discrete manipulation of valve selection, total flow rate to the web may be adjusted without flow throttling and consequent impact velocity variations.

10 Claims, 3 Drawing Figures

METHOD AND APPARATUS FOR LEVELING THE CROSS-DIRECTION PROFILE OF STOCK SLURRY ON A PAPER MACHINE

CROSS-REFERENCES TO RELATED APPLICATION

The present disclosure is a continuation-in-part of my earlier filed Application Ser. No. 710,565 filed Aug. 2, 1976 and now abandoned.

BACKGROUND OF THE INVENTION

1. Field of the Invention

The present invention relates to the art of papermaking. In particular, the present invention describes a method and apparatus for improving the web formation of fourdrinier screen laid paper.

2. Description of the Prior Art

The papermaking process generally comprises a series of drying steps whereby a continuous flow of wood fiber suspended as a dilute aqueous slurry called stock is consolidated, first, to a wet fibrous mat and finally, to a dry finished paper web.

The fourdrinier papermachine on which this drying sequence is performed comprises first, a wet or forming section followed by a press section and a dryer section. Depending on the product objective, the dryer section may be followed by a calender finishing section.

The forming section of a papermachine comprises a flow receiving vessel for the stock. This vessel, called a headbox, is provided along the bottom thereof with a narrow slit opening called the slice. The slice constitutes the flow regulation device for control of stock flow from the headbox onto a perforate belt called the fourdrinier screen. This screen is driven around a closed belt course which includes a substantially horizontal portion called the table. Stock flow from the slice onto the screen forms a standing pond of stock on the screen along the table. Before the pond is allowed to flow over the lateral edges of the screen, sufficient water is drawn from the stock through the screen by various suction devices located beneath the table. By this action, the fiber, which originally constituted only about 0.5% of the slurry on the dry weight basis, is poured upon the screen as a low viscosity fluid and is removed therefrom at the end of the table as a consolidated fibrous mat.

From the wet end forming section, the fibrous mat is carried into the papermachine press section where additional water is removed mechanically by the squeezing action of a series of low pressure roll nips to form a compacted paper web.

Following the press section, the web is directed into the dryer section comprising a series of heated drums over which the web is threaded. The dryer section removes remaining water from the web evaporatively.

Final caliper and surface finishing of the dry web is achieved in the calender section by a series of high pressure nip rolls.

For purposes of product quality control and machine adjustment, most modern papermachines are equipped with instruments, usually located after the dryer section, to monitor the web characteristics of moisture, basis weight and conditioned weight. Sensors for these instruments continuously reciprocate across the web in the cross-direction (CD) while the web travels longitudinally along the machine-direction (MD) therebeneath. When data from these instruments is visually displayed by a chart recorder or cathode ray tube, a CD profile of the measured characteristics is revealed.

The basis weight characteristic relates to the total mass of web material, water plus fiber per unit of web area; usually per 1000 ft.$^2$ or per ream (3000 ft.$^2$). Since the moisture content of the web is measured independently of the basis weight, these two characteristic values may be combined to derive the characteristic of conditioned weight which is the measure of fiber quantity, exclusive of water, present in the web per unit of area.

It is the objective of every papermaker to achieve a uniform distribution of conditioned weight and moisture throughout the web in both, the CD and MD directions thereof. However, the mechanics of variations in these characteristics are different with respect to the CD and MD directions.

In the MD direction, magnitude variations in conditioned weight are predominantly due to random occurrences of fiber floccing: in other words, uncontrolled consolidation of fiber groups occurring in the headbox or before. Poor fiber distribution due to floccing is manifested in the finished sheet by a mottled or splotchy appearance.

Conditioned weight variations that are stable as to magnitude and CD location, on the other hand, are predominately the result of CD variations in the headbox slice opening. This paper web defect is seen in the finished product as light and dark streaks of web density.

CD moisture variations that are stable as to magnitude and CD location are normally an additional consequence of an improperly adjusted slice opening. Under such circumstances, a stable, high moisture region in the CD moisture profile is also attended by correspondingly high basis weight and conditioned weight magnitude profiles. However, on occasion, a stable high moisture region in the CD profile will not be attended by a conditioned weight concentration. This is a circumstance more apt to be caused by turbulence and flow characteristics internal of the headbox. Accordingly, the condition may not be readily affected by manipulation of the slice opening.

It would seem that a zone in the finished paper web that is uniform as to conditioned weight would be acceptable notwithstanding moisture variations. However, localized moisture variations affect the dimensional stability of the finished web and for this reason, all increments of the web must be dried to a threshold minimum moisture content. Consequently, if the web is burdened with a narrow, high moisture zone along the center thereof, the lateral remainder of the web must be over-dried in order to drive the high moisture zone below the threshold minimum. The overall result of these circumstances is an inefficient expenditure and waste of thermal energy in the papermachine dryer section on 90% of the web area, for example, to dry 10% of the web to tolerance.

From the perspective of moisture concentrations unattended by conditioned weight concentrations, it would be of great value to a papermachine operator to selectively adjust the moisture distribution in the web prior to the dryer section but independently of the fiber distribution.

U.S. Pat. No. 3,407,114 discloses a prior art technique for correcting a poor CD fiber distribution condition whereas U.S. Pat. No. 2,951,007 discloses a technique of selectively adding water to a predominantly finished web having a poor CD moisture distribution condition. In addition, U.S. Pat. No. 1,989,435 teaches a technique of altering the cross-directional strength of a paper web by impinging the fourdrinier pond with a pair of CD oriented curtain sprays.

U.S. Pat. No. 3,989,085 of William E. Crosby, having the assignee in common with that of the present application, describes a method and general apparatus for correcting the formation profile of a cross-directionally located anomaly. Due to the relevance of William E. Crosby's disclosure to the present invention, the disclosure thereof is hereby incorporated by reference.

Generally, Crosby's method included an array of fluid spray sources disposed above and across the fourdrinier table to direct a linked series of CD elongated fan spray patterns of fluid into the pond at select CD locations.

The apparatus of W. E. Crosby's disclosure anticipated several techniques of volume control for the described formation profile correction method, the most basic being the manually adjustable flow control valves.

For the purpose of automatic control, variable volume pneumatic valves were implied. Automatic electrical flow control was described relative to solenoid operated valves which are normally considered as binary operators, such valves having only two operative positions of entirely closed or completely open. This type of control, however, prohibits volume control in the sense of regulation.

Although electrically operated proportional valves are available to the art for electric powered automatic flow regulation, expense greatly inhibits the use of such devices. Regardless of whether the flow control is manual or automatic, regulation in the manner described is accomplished by flow throttling which has the consequence of pressure reduction. Since spray impact velocity is a significant factor in this profile control, pressure reductions due to flow rate throttling have adverse effects on the profile correction objective.

Moreover, fixed orifice nozzles secured to the distal ends of the several CD distributed conduits downstream of each flow control valve are designed to issue a precise pattern at a particular combination of flow rate and pressure drop. If this combination is significantly changed, so, too, is the nozzle spray pattern. Accordingly, over a full range of flow rate variation, the spray fan width may change 50% or more. Consequently, at the upper end of the flow rate range, adjacent spray fans may overlap excessively thereby flooding the overlapped swath. On the lower end of the flow rate range, adjacent spray fans will not meet thereby leaving strips in the pond unaffected by the sprays.

SUMMARY OF THE INVENTION

It is, therefore, an objective of the present invention to teach the construction of a web profile correction system having an adequate degree of flow regulation accomplished with the simplicity of a binary command system. Another object of the present invention is to teach a web profile corrective spray system having a variable flow rate without affecting the spray impact velocity or fan width.

Another object of the present invention is to teach the construction of a spray system for web profile correction wherein each spray station across the web CD is serviced by three binary command flow valves activating different capacity spray nozzles to achieve eight distinct flow rates over the full flow control range.

These and other objects of the invention are accomplished by means of a single fluid supply manifold extended across the CD of a papermachine fourdrinier in the vicinity of the headbox slice opening. At each spray station across the machine (approximately 6 inch spacings) three independent spray conduits are connected with the manifold. Between the manifold and a fixed orifice fan spray nozzle at the distal end of each conduit is a binary command solenoid valve.

The three spray heads respective to each spray station are positioned to impact the web pond along the same CD line located between the slice landing and the fourdrinier "dry line." Additionally, each spray head of a respective station is preferably restricted to a different flow rate whereby select flow combinations from respective spray heads will provide uniform flow rate differential increments over the total flow spectrum up to the maximum flow rate capacity of the station.

A specific example of the invention teaches a control panel array of one cascade rotary switch for each spray station and an orifice restriction of 1, 2 and 4 gpm flow rate respective to the three spray heads. Consequently, a combination of eight flow rates of from zero to seven gallons-per-minute may be applied to the pond in one gallon-per-minute differential increments.

BRIEF DESCRIPTION OF THE DRAWING

Relative to the drawing wherein like reference characters designate like or similar elements throughout the several figures.

DESCRIPTION OF THE PREFERRED EMBODIMENT

Figure 1:
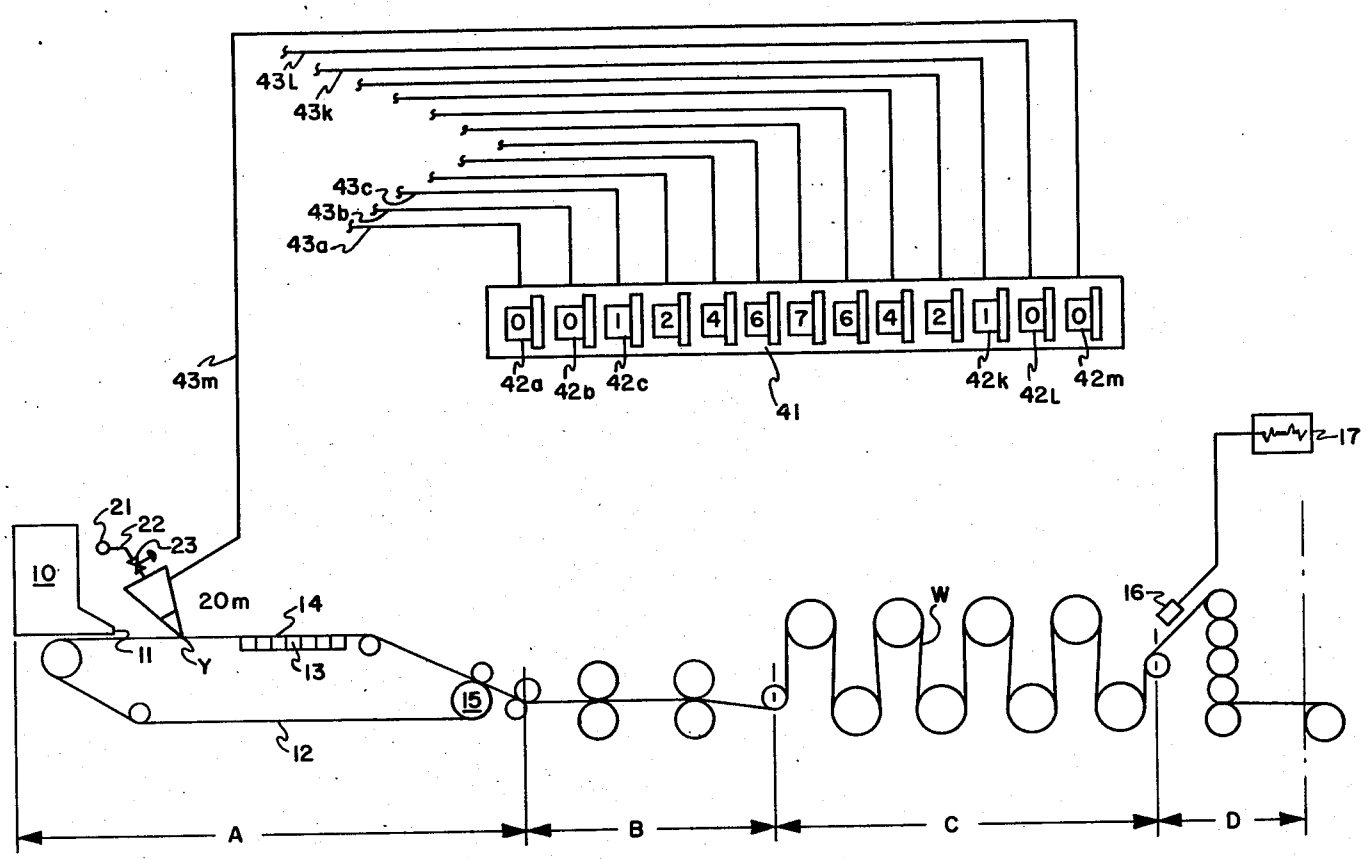
FIG. 1 illustrates a profile schematic of a fourdrinier papermachine.

For purposes of orientation, FIG. 1 schematically illustrates a typical fourdrinier papermachine comprising a web formation section A, a wet press section B, a dryer section C and a calender section D.

The web formation section A comprises a headbox 10 having a slice opening 11 located at the headbox bottom above the fourdrinier screen 12. A series of suction boxes 13 are spaced along the screen table 14 between the slice 11 and the couch roll 15.

Figure 3:
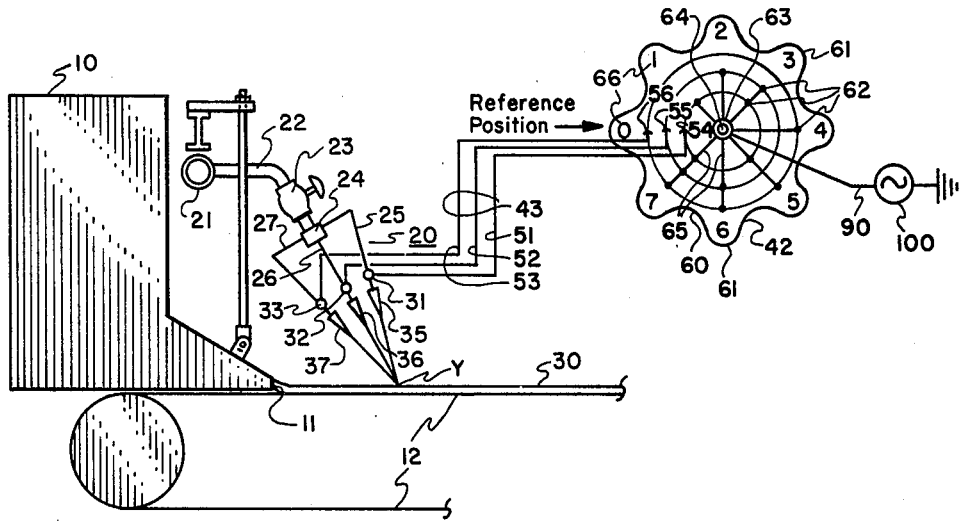
FIG. 3 illustrates a typical electrical control circuit for the present invention.
Figure 2:
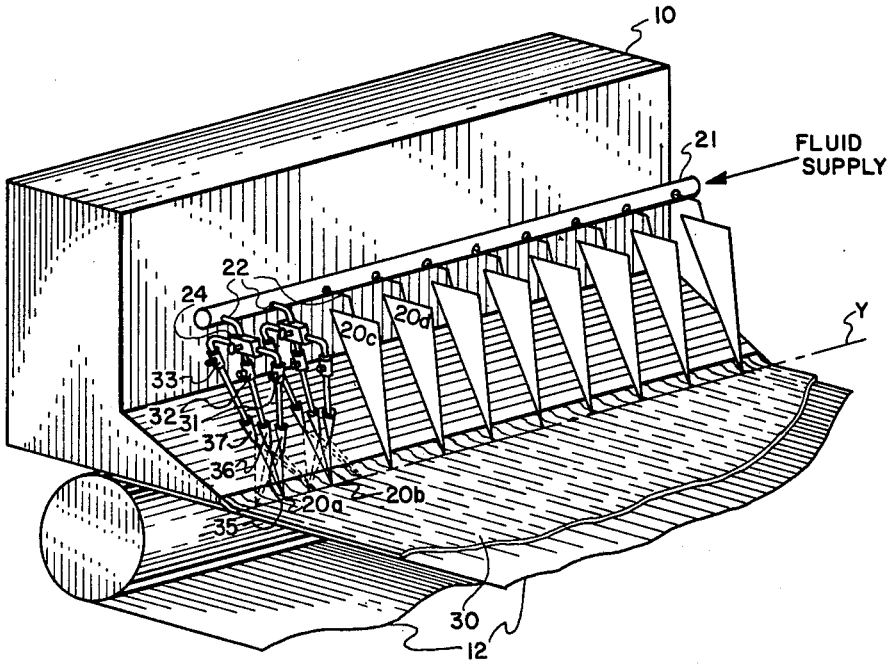
FIG. 2 illustrates an enlarged schematic of the headbox end of a papermachine equipped with the present invention.

Illustrated by FIGS. 2 and 3 is the profile control system particular to the present invention comprising a fluid manifold 21 having a plurality of equally spaced extensions 22 depending therefrom. Each extension 22 services a respective spray station **20*a*, 20*b*, 20*c*, etc. along the manifold line and is provided with a flow obstructing valve 23 between the spray station appurtenances and the manifold 21**.

Below each valve 23 is a sub-manifold distributor 24 having three outlet ports for conduits 25, 26 and 27, respectively. In the flow line of conduits 25, 26 and 27 are binary command, remote operated valves 31, 32 and 33. Power for the remote control of valves 31, 32 and 33 may be by means of electricity, pneumatics or hydraulics. In the preferred embodiment and for the purpose of this example, valves 31, 32 and 33 shall be described as electric solenoids.

Downstream of each valve 31, 32 and 33 are spray nozzles 35, 36 and 37, respectively. These nozzles emit a fan-spray pattern and are positioned above the plane of the fourdrinier pond at a height which corresponds to the angular spread of the spray fan and the desired impact velocity. The angular spread of the spray fan is also determinative of lateral spacing between CD adjacent spray stations, the spacing being such to provide an approximately one-half inch overlap of adjacent spray fans.

In the machine direction (MD), measured parallel with the running direction of the fourdrinier screen 12, the nozzles 35, 36 and 37 are angularly separated about the "Y" axis by approximately 10°. This arrangement places the discharge jet axis of nozzle 35 at approximately 70°, nozzle 36 to 60° and nozzle 37 at 50° of the table plane 14.

Axis "Y" is normally located approximately 1.5 to 4 feet down the table plane 14 from the slice 11 and represents the line of impact along which the jets of all nozzles will collide with the traveling fourdrinier pond 30.

On some stock, basis weight and machine combinations, however, the effective MD location range for positioning the "Y" axis may be extended substantially to accommodate other machine equipment in the immediate proximity of the slice. At least one instance has proven an effective location for the impact line at 6 feet down from the slice landing. More subjectively, the impact line must be located within the pond zone of the fourdrinier where the individual stock fibers are still sufficiently fluid and mobile as to tolerate displacement by the spray impact and subsequently reverse flow to level and smooth the boundaries of the channeled swath following the spray before such fibers are positionally set at the "dry line" end of the pond. This state of conditions more generally determinative of the impact line MD location is characterized as the fiber mobile zone of the pond.

For optimum flexibility as to total flow rate increment spacing, nozzles 35, 36 and 37 should be selected with different orifice sizes to issue relatively proportional flow rates and spray fan width under the same pressure drive. A representative orifice size distribution among three nozzles under a 40 psi manifold pressure may be, for example, 1 gpm for nozzle 35, 2 gpm for nozzle 36 and 4 gpm for nozzle 37, the proportionality being:

$$F_n = 2^{n-x}$$

where:

$F_n$ = flow rate available from nozzle n x = flow rate sizing factor which differs between particular nozzles of a respective station by a unit quantity n = unit number identity of a particular nozzle in a spray station sub-system As an operative example of the foregoing relation, assume a spray station having 3 nozzles and a sizing factor of 1. For the first nozzle, $n=1$ and $x=1$. Accordingly, $F_1=2^0=1$. For the second nozzle, $n=2$ and $x=1$, therefore $F_2=2^1=2$. For the third nozzle, $n=3$ and $x=1$ so $F_3=2^2=4$.

Manifold 21 is sized and provided with a fluid supply of such capacity as to maintain the desired line pressure throughout the full span of expected flow rate demanded by the spray system. Depending on the desired basis weight of the web being laid, the pressure within manifold 21 may range from 20 to 100 psi. For most applications however, a 40 to 60 psi pressure range is more appropriate for a 33 pounds per ream web basis weight target moving at a screen speed of 1335 fpm to deliver a water spray into impact with the pond at 77 fps velocity. The total fluid flow rate delivered under such conditions will vary with the machine speed, the basis weight target and the magnitude of localized fiber concentration being treated. However, regardless of total hydraulic power delivered to the web, the spray impact velocity should preferably be in the range of 70 to 100 fps to generate the necessary fiber fluidizing shock disturbance.

Control over the many binary command valves 31, 32 and 33 necessary for a large, 260 inch deckle width papermachine may be conveniently asserted by means of a command station which comprises a panel array 41 of rotary thumbwheel switches **42*a*, 42*b*, 42*c*, etc. such as that shown in FIG. 1. The single line control circuits 43*a*, 43*b*, 43*c*, etc. to the valves 31, 32 and 33 of a respective spray station 20*a*, 20*b*, 20*c*, etc. in fact, each represent three conduits 51, 52 and 53 respective to valves 31, 32 and 33 as illustrated by FIG. 3**.

The typical schematic of FIG. 3 shows switch 42 to be interposed in the circuit continuity between a spray station 20 and a power source 100. Conductor 90 connects the power source to a conductive hub 63. A non-conductive thumbwheel disc 60 is secured to the hub 63. Also secured to the disc 60 are radial conductors 65 and contact points 62 in continuity with the hub 63 and journal 64.

Around the periphery of disc 60 are eight thumb lobes 61 uniquely identified by indicia 66. In this example, the indicia also state the total fluid flow rate in gpm units applied to the web pond 30 from the respective spray station 20.

Stationary brush contacts 54, 55 and 56 are respectively connected via conduits 51, 52 and 53 to the solenoid actuators of valves 31, 32 and 33. Relative to the reference position shown on the drawing opposite from disc lobe "0", there are no power transmissive contact points 62. Consequently, when the disc 60 is placed in this angular alignment relative to the reference position, none of the valves 31, 32 and 33 will be energized. Assuming an "energized-on" type of valve operation, fluid flow to all nozzles 35, 36 and 37 will be blocked.

When the disc 60 is rotated about the axis of journal 63 to an angular position that aligns disc lob "1" with the reference position, the contact point 62 in radial alignment with the lobe "1" will contact brush 54 to energize valve 31 thereby issuing fluid spray from nozzle 35 which applies one gpm of fluid to the pond 30 under the selected spray station 20.

Since the disc lobe position "1" provides no other contacts 62 along this particular radius, valves 32 and 33 will remain de-energized.

When the foregoing principle is applied to the six other angular positions of disc lobes 61 and the corresponding radial positionment of contacts 62 relative to brushes 54, 55 and 56, it will be seen that each angular position commands a respectively unique total fluid flow rate from the three valve combination of each spray station 20. In this manner, greater fluid flow rates may be applied to the pond 30 by those spray stations 20 at the center of a fiber concentration streak; the flow rates from spray stations located laterally of the concentration center being graduated down as illustrated by the switch 42 settings on panel 41 of FIG. 1. Additionally, such flow rate graduations may be achieved at substantially the same impact velocity from all operative nozzles so long as the single supply manifold 21 carries sufficient pressure to maintain a critical pressure differential.

The end result of the invention on the web pond 30 is that a streak of heavy fiber concentration, as detected by a basis weight scanning sensor 16, for example, and reported by an appropriately calibrated and referenced oscilloscope 17, may be uniformly distributed over the entire web CD. The impact shock of the spray stream fluidizes the fiber concentration while the laterally graduated flow rate provides a laterally flowing fluid vehicle to carry and deposit such fiber where desired in appropriate concentrations.

As explained in greater detail by said U.S. Pat. No. 3,989,085, the fluid impacting principle described above relative to fiber and basis weight redistribution is also relevant to moisture concentrations. In such cases the condition profile sensor 16 is of a type well known to the art for detecting the proximate water mass, independent of fiber. The effective working fluid issued from the spray nozzles is air. In other words, if the single paper stock constituent to be redistributed is fiber, the appropriate working fluid is water. On the other hand, if the single stock constituent to be redistributed is water, independent of fiber, the appropriate working fluid is air.

For the purpose of teaching a preferred embodiment, operational control over the present invention has been described relative to a command station which comprises a panel array of rotary cascade switches 42. It should be understood, however, that numerous other switching techniques may be utilized with equal effectiveness. For example, each nozzle flow control valve 31, 32, or 33 may be provided with an independent single pole, single throw switch, the decision of which switch to close for a desired flow rate combination being left to the operator.

Having fully and completely described my invention, I claim:

1. An apparatus for leveling the cross-directional distribution of a fiber or water paper stock constituent within a dilute aqueous slurry deposited continuously upon a machine-direction traveling foraminous screen as the first of several water removal steps in a paper web forming sequence, said constituent leveling apparatus comprising:

A. A papermachine headbox containing said dilute aqueous slurry of stock and having a cross-directionally elongated slice opening adjacent said traveling screen for depositing a fluidized pond of said stock slurry thereon;

B. Cooperative sensing means and reporting means for detecting the cross-directional concentration profile of a single stock constituent within a continuously forming paper web consolidated from said stock slurry and reporting the magnitude of such concentrations relative to the cross-directional location thereof;

C. A fluid supply manifold;

D. A plurality of fluid spray stations distributed cross-directionally across said traveling screen and connected to said manifold or fluid supply therefrom; each of said spray stations comprising a plurality of fixed orifice fan spray nozzles for providing different incremental station flow rates, each nozzle of a respective station sized to discharge a respective flow rate of fluid at substantially the same velocity and spray width upon impact with said stock as such other nozzles in said respective station, all of said respective station nozzles being positioned to strike with a fluid spray issuing therefrom the same increment of a line extended across the plane of said web pond within a fiber mobile zone located between a line of stock landing upon said screen and a dry line formed thereon;

E. A binary command, full flow, remote controlled valve respective to each nozzle disposed in a respective fluid conduit between each nozzle and said supply manifold; and F. Command station means for selectively emitting binary command signals to each of said controlled valves.

2. An apparatus as described by claim 1 wherein each nozzle of a representative station is sized to discharge a fluid flow rate that is different from other nozzles in said representative station.

3. An apparatus as described by claim 2 wherein the plurality of nozzles respective to a particular spray station are relatively sized to issue a fluid flow rate substantially according to the relation $F_n=2^{n-x}$ where F is the flow rate capacity of nozzle n and x is a flow rate sizing factor which differs between particular nozzles of a respective station by a unit quanity.

4. An apparatus as described by claim 2 wherein said binary command valves are electrically actuated to the full flow condition and said command station means comprises an array of rotary cascade switches, each switch serving the valves of a respective station and each rotary position of said switch operatively opening a different combination of said valves.

5. In a fiber or water paper stock constituent cross-directional concentration leveling system for a papermachine comprising a headbox with a slice opening for laying a pond of stock on a traveling fourdrinier screen, a cross-directioal stock constituent profile sensing means, a reporting system for said sensing means, and a plurality of fan spray nozzles distributed across said papermachine for issuing a spray of fluid onto said pond, the improvement comprising:

A. A plurality of spray stations distributed across said papermachine, each spray station comprising a plurality of fixed orifice fan spray nozzles for providing different incremental station flow rates, each nozzle of a respective station sized to discharge a respective fluid flow rate at substantially the same velocity and spray width upon impact with said stock as such other nozzles, all nozzles respective to a station being positioned to impact said pond with said discharge along the same increment of a line traversing the plane of said pond within a fiber mobile zone located between a line of stock landing upon said screen and a dry line formed thereon;

B. Binary command, full flow valve means disposed in a fluid conduit between each of said nozzles and a fluid supply manifold; and C. Control means for directing respective binary commands to each of said flow valve means.

6. A system as described by claim 5 wherein the plurality of nozzles respective to a particular spray station are relatively sized to discharge a fluid flow rate substantially according to the relation $F_n=2^{n-x}$ where F is the flow rate capacity of a respective nozzle n and x is a flow rate sizing factor which differs between particular nozzles of a respective spray station by a unit quantity.

7. A system as described by claim 5 wherein said binary command valves are electrically actuated to the full flow condition and said control means comprises an array of rotary cascade switch means, each switch means serving the valves of a respective station and each rotary position of said switch operatively opening a different combination of said valves.

8. A method of leveling the cross-directional profile of a paper stock constituent of either fiber or water subsequent to landing on a traveling foraminous screen, said method comprising the steps of:

A. Providing a plurality of fluid spray sources distributed substantially equidistantly across said screen to issue a cross-directionally elongated fan spray pattern of fluid impacting a pond of said stock on said screen along a cross-directional line within a fiber mobile zone of said pond between a line whereat said stock lands on said screen and a dry line formed in said stock on said screen;

B. Sensing the cross-directional location of an undesirable concentration of said constituent within a consolidated web emerging continuously from said screen;

C. Providing a reference flow rate of fluid from one of said sources most proximate of the cross-directional center of said concentration;

D. Providing other flow rates of fluid from other of said sources laterally adjacent said one source, said other flow rates being less than said reference flow rate and diminishing in graduated increments relative to the order of location removal of a respective other source from said one source; and E. Maintaining a substantially uniform fluid impact velocity and fan spray width from all of said plurality of said sources having a flow rate.

9. A method as described by claim 8 wherein each of said fluid spray sources comprises a plurality of spray nozzles of respectively different flow rate capacity, the combination of flow rate capacities respective to the nozzles of a single source being the same for all sources, and the lateral flow rate diminution of said other sources being achieved between laterally adjacent sources by discrete operational combinations of flow rates from the plurality of nozzles respective to a source.

10. A method as described by claim 9 comprising the steps of supplying all of said nozzles with fluid at a uniform pressure and selectively interrupting said supply by the operation of a binary command full flow valve respective to each nozzle.

* * * * *